US009373459B1

(12) United States Patent
Mininberg

(10) Patent No.: US 9,373,459 B1
(45) Date of Patent: Jun. 21, 2016

(54) LOCKOUT/TAGOUT DEVICE FOR CONTROL SWITCHES

(71) Applicant: Gus J. Mininberg, Albany, NY (US)

(72) Inventor: Gus J. Mininberg, Albany, NY (US)

( * ) Notice: Subject to any disclaimer, the term of this patent is extended or adjusted under 35 U.S.C. 154(b) by 0 days.

(21) Appl. No.: 14/595,637

(22) Filed: Jan. 13, 2015

(51) Int. Cl.
*H01H 9/28* (2006.01)

(52) U.S. Cl.
CPC ..... *H01H 9/282* (2013.01)

(58) Field of Classification Search
CPC ..... H01H 9/282; H01H 9/283; H01H 9/287; H01H 9/286
USPC ..... 200/43.01, 43.11, 43.14–43.16, 43.19, 200/43.21–43.22, 50.01–50.4
See application file for complete search history.

(56) References Cited

U.S. PATENT DOCUMENTS 4,260,861 A * 4/1981 DiMarco ..... H01H 9/282 200/43.15
5,322,980 A * 6/1994 Benda ..... H01H 71/1018 200/43.11
5,732,815 A * 3/1998 Brouwer ..... H01H 9/283 200/43.11
5,817,999 A 10/1998 Mugan et al.
7,692,108 B1 * 4/2010 Larranaga ..... H01H 9/283 200/43.14
8,629,359 B2 * 1/2014 Hackett ..... H01H 9/283 200/43.14

FOREIGN PATENT DOCUMENTS

EP 0824263 2/1998
GB 1528692 10/1978
WO 2009135266 11/2009

OTHER PUBLICATIONS

International Search Report Form PCT/ISA/220, International Application No. PCT/US2015/050329,pp. 1-12, Dated Dec. 15, 2015.

* cited by examiner

*Primary Examiner* — Edwin A. Leon
(74) *Attorney, Agent, or Firm* — Bond Schoeneck and King PLLC; David Nocilly

(57) ABSTRACT

A pivoting lockout member that is mounted to a pair of hinge member installed onto a control switch. Each of the hinge members includes a planar flange having a hole formed therethrough that is dimensioned to accept the face plate screw of a control switch. The lockout member has a pair of hinge arms that are connected together and spaced apart by a central U-shaped member. A pair of lock flanges extend at right angles to the U-shaped member and have holed formed therethrough that are aligned with each other to accept a conventional padlock. The locking member is moved between an unlocked position where the control switch handle is free to move, and a locked position where the U-shaped member captures the handle and prevent it from being operated.

5 Claims, 4 Drawing Sheets

LOCKOUT/TAGOUT DEVICE FOR CONTROL SWITCHES

BACKGROUND OF THE INVENTION

1. Field of the Invention

The present invention relates to lockout/tagout systems and, more specifically, a lockout/tagout device for use with pistol grip control switches.

2. Description of the Related Art

Proper lockout/tagout practices and procedures safeguard workers from the release of hazardous energy and typically involve the locking and tagging of energy equipment to isolate that equipment from use and otherwise prevent its use when unsafe or if the equipment is being serviced. For example, circuit breakers may be placed in the off position and the circuit breaker cabinet locked against use until the associated equipment may be safely placed back into service. However, certain control switches for medium and high voltage circuit breakers, such as those having pistol grip handles, cannot be safely locked into the off position and properly tagged as the switches lack any locking mechanism. Accordingly, there is a need in the art for a system that can safely and securely lockout/tagout such equipment.

BRIEF SUMMARY OF THE INVENTION

The present invention comprises a lockout/tagout system having a pair of hinges that are mountable on the face of a control switch and a pivoting locking member attached to the hinges. The locking member is moveable between an unlocked position, where the handle of the switch may be moved by a user, and a locked position, wherein the locking member prevents movement of the switch handle. The locking member generally comprises a pair of hinge arms having posts for coupling to the hinges and a U-shaped member that spaces the arms apart and provided a central opening through which the switch handle may pass as the locking member is moved between the unlocked and locked position and that prevents movement of the switch when the locking member is in the locked position.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
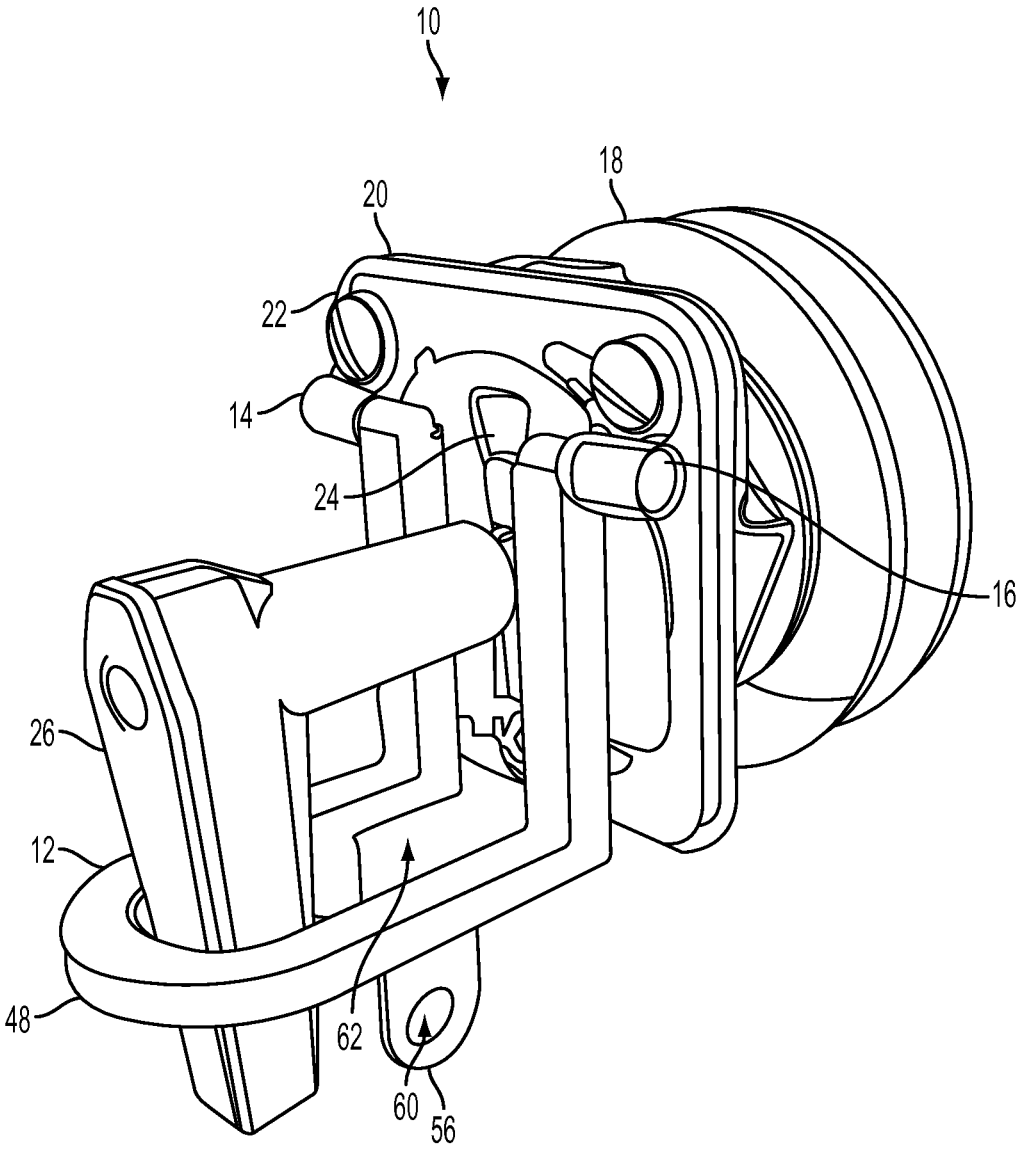
FIG. 1 is a perspective view of a lockout/tagout system for a control switch of a circuit breaker according to the present invention.

Referring now to the drawings, wherein like reference numerals refer to like parts throughout, there is seen in FIG. 1 a lockout/tagout device 10 for use with control switches used on medium and high-voltage circuit breakers. System 10 comprises a pivoting lockout member 12 that is mounted to a pair of hinge member 14 and 16 installed onto a control switch 18. Control switch 18 conventionally comprises a face plate 20 attached to control switch 18 by one or more screws 22, a display screen 24, and a handle 26 for manually operating control switch 16.

Figure 2:
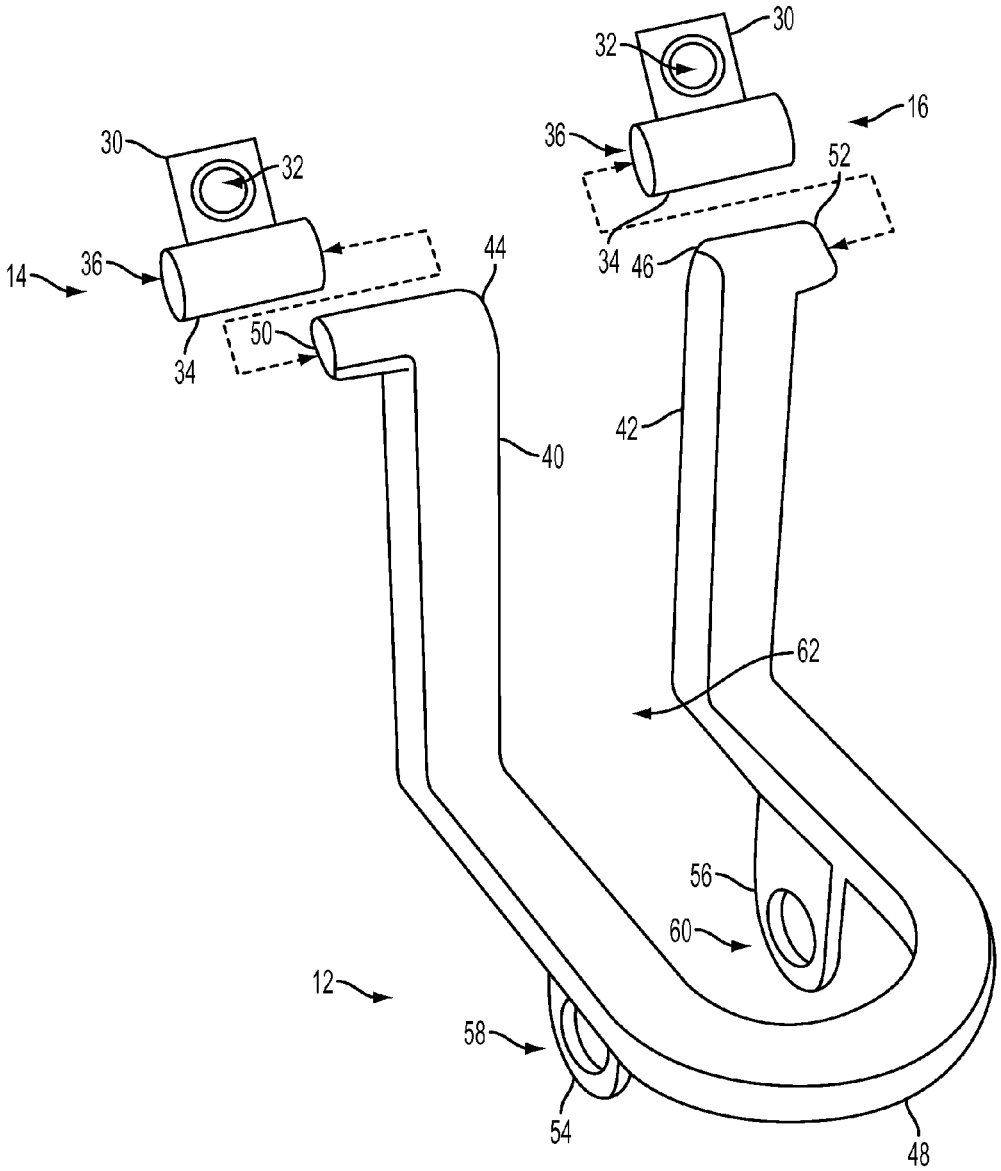
FIG. 2 is a perspective view of locking member and accompanying hinges for a control switch of a circuit breaker according to the present invention.

Referring to FIG. 2, each of hinge members 14 and 16 includes a planar flange 30 having a hole 32 formed therethrough that is dimensioned to accept screw 22. Flange 30 of each hinge member 14 and 16 is coupled to a tubular member 34 having a through bore 36. Preferably, bore 36 extends along an axis that is parallel to the plane of flange 30 so that bore 34 will extend laterally across the face of control switch 18 when flange 30 is used to mount hinge 14 or 16 to control switch 18 using screw 20 inserted through hole 32.

As further seen in FIG. 2, lockout member 12 comprises a pair of hinge arms 40 and 42 having a pair of free ends 44 and 46 that are connected together and spaced apart by a central U-shaped member 48 that extends at right angles to hinge arms 40 and 42. A pair of posts 50 and 52 extend outwardly from each of free ends 44 and 46, respectively, and are dimensioned to fit into bore 36 of hinge members 14 and 16 for pivotally movement of lockout member 12 relative to hinge members 14 and 16, and thus control switch 18, when hinge members 14 and 16 are installed onto control switch 18 and locking member 12 is attached to hinge members 14 and 16. A pair of lock flanges 54 and 56 extend at right angles to U-shaped member 48 and include a holes 58 and 60 formed therethrough that are aligned with each other to accept the shank of a padlock. U-shaped member 48 and spaced apart arms 40 and 42 define a central passage 62 through which switch handle 26 may pass as locking member 12 is moved between the unlocked and locked positions. Once handle 26 is positioned in passage 62, it may not be moved by a user as it is securely captured within U-shaped member 48.

System 10 may be used to institute a lockout/tagout operation of control switch 18. Preferably, hinge members 14 and 16 are installed on control switch 18 prior to the need to initiate a lockout/tagout operation, but hinge members 14 and 16 may be installed at the time of the lockout/tagout operation. Hinge members 14 and 16 may thus be affixed to the front of control switch 18 by positioning hinge members 14 and 16 on control switch 18 prior to mounting face plate 20 thereon, or after face plate 20 has been attached by removing screws 22, positioning hinge members 14 against face plate 20, and then reattaching face plate 20 using screws 22.

Figure 3:
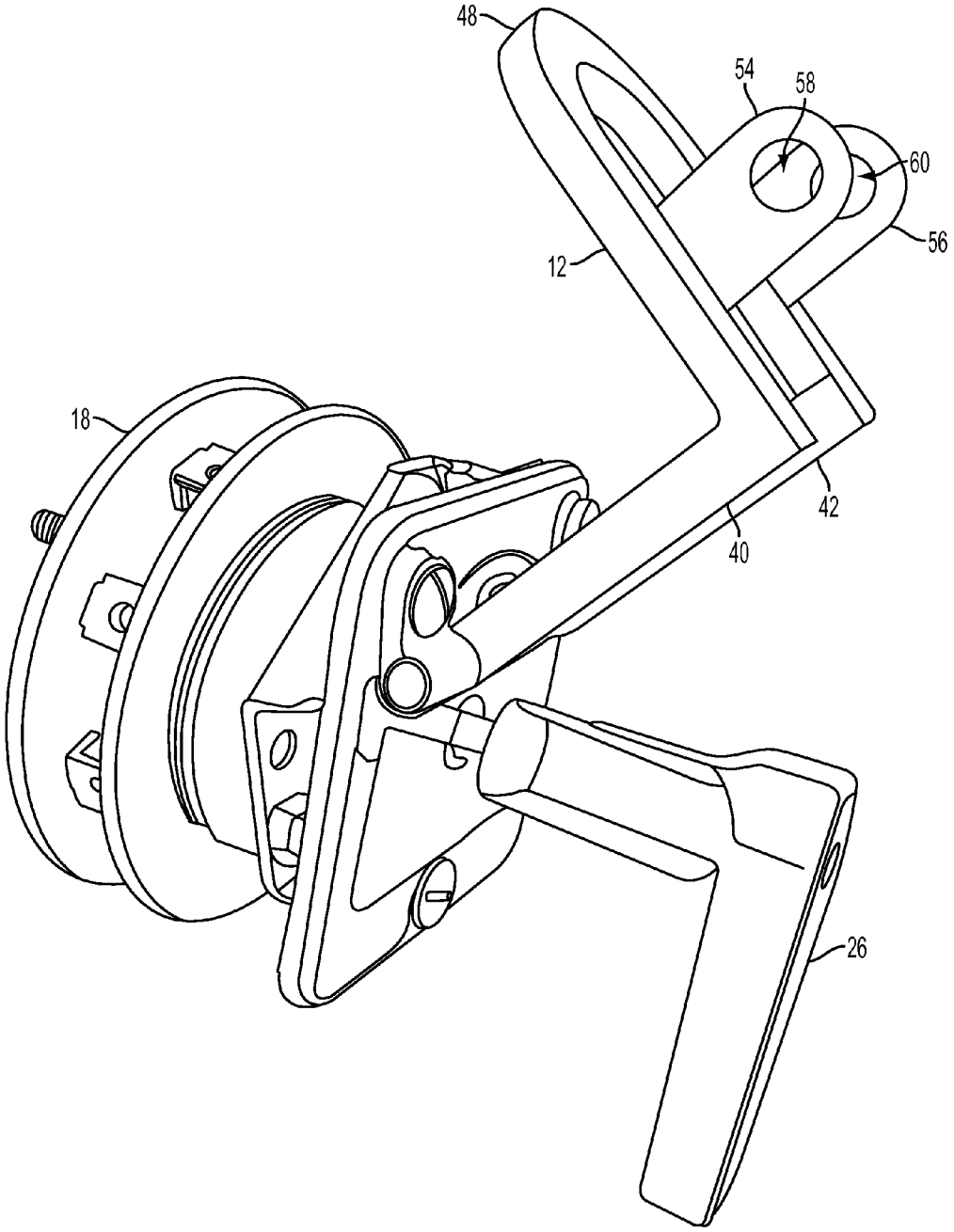
FIG. 3 is a perspective view of a lockout/tagout system according to the present invention in the unlocked position.
Figure 4:
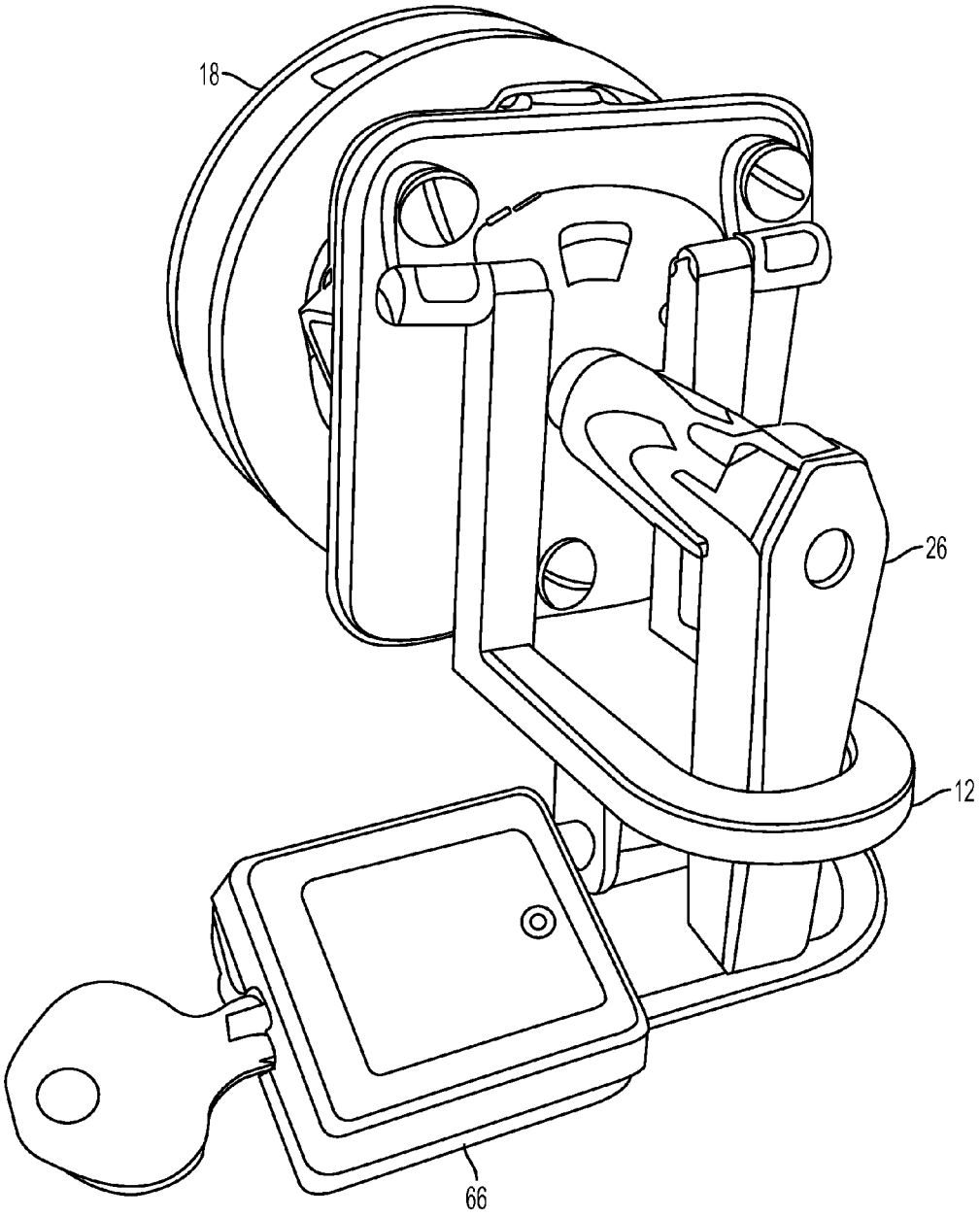
FIG. 4 is a perspective view of a lockout/tagout system according to the present invention in the locked position.

Once hinge members 14 and 16 are positioned on control switch 18, locking device 12 may be attached to hinge members 14 and 16 by positioning each of posts 50 and 52 into the corresponding bore 34 of each of hinge members 14 and 16. Locking device 12 may be pivoted between an unlocked position, as seen in FIG. 3 where locking device 12 is out of engagement with handle 26 of control switch 18, and a locked position, as seen in FIG. 4 where locking device 12 is engaged with handle 26 of control switch 18. As further seen in FIG. 4, when locking device 12 is engaged with handle 26 of control switch 18, U-shaped member 48 captures handle 24 so that handle 24 may not be moved. In this position, a conventional padlock 66 may be installed onto locking device 12 using lock flanges 54 and 56 and holes 58 and 60 to prevent any pivoting of locking device 12 into the unlocked position until padlock 66 is removed by an authorized person.

It should be recognized by those of skill in the art that locking device 12 can be dimensioned to fit various size control switches 18, with lock flanges 54 and 56 sized to accommodate standard padlocks 66 used in lockout/tagout operations. Locking device 12 may be made from various materials, such as plastics and metals, and can be color red to appropriately indicate safety usage. For example, locking device 12 may be manufactured to comply with safety standards, such as OSHA 1910.147. Notably, even when locking device 12 is not be used for a lockout/tagout operation, it may be left in the locked position to prevent accidental operation of the switch.

What is claimed is:

1. A device for locking out a circuit breaker having a pistol grip handle, comprising:

a central member extending in a curve;

a pair of arms extending from the central member to define a cavity therebetween;

a post extending from a free end of each arm; and a flange having a hole formed therethrough extending from an intermediate portion of each, wherein the pair of arms each include a first portion extending from the central member and a second portion extending at right angles to the first portion, wherein the cavity is dimensioned to accept a pistol grip handle of a circuit breaker, wherein the holes of the flanges are aligned with respect to each other to accept a shank of a padlock, further comprising a pair of hinges, each of which includes a hole formed therethrough and a tubular member dimensioned to accept the post of one of the arms.

2. A method of locking out a circuit breaker having a pistol grip handle, comprising the steps of:

attaching a pair of hinges, each of which includes a hole formed therethrough and a tubular member dimensioned to accept the post of one of the arms, to a circuit breaker having a pistol grip handle;

positioning a locking device having a central member extending in a curve, a pair of arms extending from the central member to define a cavity therebetween, a post extending from a free end of each arm, and a flange having a hole formed therethrough extending from an intermediate portion of each arm so that the post of each arm pivotally engages a respective one of the pair of hinges;

pivoting the locking device so that the cavity captures the pistol grip handle of the circuit breaker;

attaching a padlock to the locking device by positioning the shank of the padlock through the holes of the flanges of the pair of arms.

3. The method of claim 2, wherein the pair of arms each include a first portion extending from the central member and a second portion extending at right angles to the first portion.

4. The method of claim 3, wherein the cavity is dimensioned to secure the pistol grip handle of the circuit breaker against movement.

5. The method of claim 4, wherein the hole of each flange is aligned to the other hole of the other flange to accept the shank of a padlock.

* * * * *